US008162567B2

(12) United States Patent
Obermeyer

(10) Patent No.: US 8,162,567 B2
(45) Date of Patent: Apr. 24, 2012

(54) WATER RETENTION CELL STRUCTURES

(75) Inventor: Michael B. Obermeyer, Charlotte, NC (US)

(73) Assignee: Polyguard Products, Inc., Ennis, TX (US)

( * ) Notice: Subject to any disclaimer, the term of this patent is extended or adjusted under 35 U.S.C. 154(b) by 141 days.

(21) Appl. No.: 12/799,147

(22) Filed: Apr. 20, 2010

(65) Prior Publication Data

US 2011/0255921 A1 Oct. 20, 2011

(51) Int. Cl.
*E02B 11/00* (2006.01)

(52) U.S. Cl. ..... 405/50; 405/45; 405/43; 405/53

(58) Field of Classification Search ..... 405/43, 405/44, 45, 50, 52, 53
See application file for complete search history.

(56) References Cited

U.S. PATENT DOCUMENTS

| | | | | |
|---|---|---|---|---|
| 4,733,989 | A * | 3/1988 | Harriett | 405/50 |
| 4,840,515 | A * | 6/1989 | Freese | 405/45 |
| 4,925,342 | A * | 5/1990 | Hendy | 405/45 |
| 4,956,951 | A * | 9/1990 | Kannankeril | 405/45 |
| 5,383,314 | A * | 1/1995 | Rothberg | 405/45 |
| 5,688,073 | A * | 11/1997 | Brodeur et al. | 405/50 |
| 5,692,348 | A * | 12/1997 | Ambrosino | 405/45 |
| 6,095,718 | A * | 8/2000 | Bohnhoff | 405/52 |
| 6,802,668 | B2 * | 10/2004 | Parker | 405/49 |
| 7,014,390 | B1 * | 3/2006 | Morris | 405/50 |

* cited by examiner

*Primary Examiner* — Frederick L Lagman
(74) *Attorney, Agent, or Firm* — Jack A. Kanz

(57) ABSTRACT

An assembly of hollow frustum-shaped bodies arranged and supported on a horizontal support structure is used to form a core structure for water retention cells. The assemblies are arranged in alternately inverted layers with the ends of the frustum-shaped bodies interconnected to form vertical support columns which are horizontally stabilized by horizontal support structure.

13 Claims, 6 Drawing Sheets

WATER RETENTION CELL STRUCTURES

This invention relates to collection and storage of storm water. More particularly, it relates to subsurface water storage structures and methods of making same.

Raw undeveloped land is generally porous, allowing direct infiltration of rainfall. Such infiltration recharges subsurface water-bearing strata and generally limits run-off flooding while filtering out some pollutants. Development of land for commercial or residential purposes, however, significantly impairs natural infiltration. Where the surface is covered with permanent or semi-permanent structures such as roads, walkways, parking lots, structures with roofs and the like, natural infiltration is blocked or substantially impaired.

Interference with surface infiltration results in rapid and excessive run-off water which causes flooding and pollution of surface water resources. Accordingly, national, regional and local regulatory agencies now often require all or part of rainfall run-off (conventionally referred to as storm water) to be managed onsite.

Traditionally, storm sewers and the like have been used to conduct storm water to run-off channels or the storm water is collected in detention basins or ponds. Such open storage facilities, however, not only occupy valuable real estate, they create safety hazards and tend to attract unwanted insects and other creatures as well as causing odor problems and weed growth. To minimize these hazards, subsurface storage facilities have been developed where excess run-off can be temporarily stored until it percolates into adjacent earth or is removed for other uses.

Most conventional subsurface storage facilities comprise layers of gravel and/or crushed rock contained in a pit or the like in which the water may be collected and gradually removed by drainage, seepage and the like. Unfortunately, the water retention capacity of such systems is severely limited by the volume occupied by the crushed rock, etc. More recently, storage systems have been developed which employ a matrix or grid of interlocking support structures such as disclosed in U.S. Pat. No. 6,095,718 disposed in an enclosed cell structure. Such support structures occupy less space than crushed rock and the like and thus permit greater water retention capacity in smaller spaces but are often structurally unstable and are relatively expensive to manufacture and install, thus limiting their practical utility.

In accordance with the present invention, an assembly is provided which may be used as the support matrix or core in subsurface water retention systems which employ water retention cells or envelopes. In its simplest form the assembly comprises a plurality of hollow frustum-shaped bodies arranged in a supporting matrix with the ends of the frustum-shaped bodies aligned in parallel planes so that multiple assemblies may be stacked in alternating inverted layers with the ends of the frustum-shaped bodies connected to provide structural support columns. With the assemblies stacked in alternately inverted layers, the larger ends of the frustum-shaped bodies in one layer are connected to the larger ends of the frustum-shaped bodies in an adjacent layer and the smaller ends of the frustum-shaped bodies in one layer are connected to the smaller ends of the frustum-shaped bodies in an adjacent layer, resulting in a core matrix which, when positioned within a storm water retention cell, provides an extremely strong and rigid core structure. The assembly may be constructed of inexpensive materials and arranged to occupy less than three percent (3%) of the fluid volume of the water retention cell. Since the hollow bodies are frustum-shaped, the assemblies may be compactly nested and stacked for shipment but easily and readily arranged in alternately inverted layers onsite without special assembly tools or the like. The alternately inverted and interconnected frustum-shaped bodies provide extremely high compressive strength columns so that the core matrix provides a high strength rigid base for supporting heavy overburden without substantially reducing the fluid retention capacity of the subterranean cell and without the necessity of providing excessively strengthened cell wall and top structures. Other features and advantages will become more readily understood from the following detailed description taken in connection with the appended claims and attached drawing in which:

Figure 1:
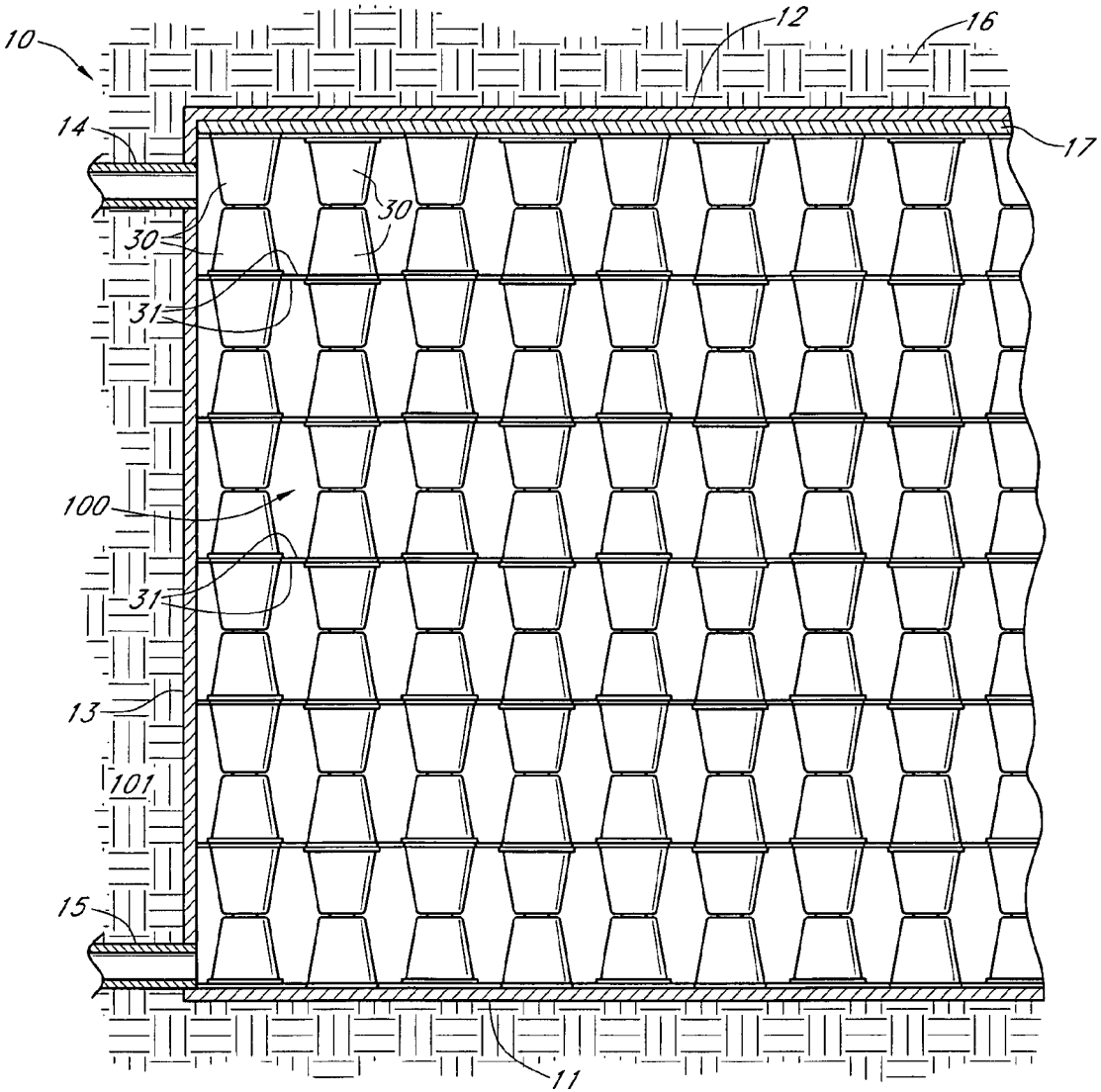
FIG. 1 is a sectional view, partially broken away, illustrating an enclosed water retention cell employing a core matrix of stacked assemblies of one embodiment of the invention.

The above-described drawing is incorporated into and forms part of the specification to illustrate an exemplary embodiment of the invention. Throughout the drawing like reference numerals designate corresponding elements. The figures are not to scale but are intended to disclose the inventive concepts by illustration. This drawing, together with the description herein, serves to explain the principles of the invention and is only for the purpose of illustrating preferred and alternative examples of how the invention can be made and used.

It will be recognized that the principles of the invention may be utilized and embodied in many and various forms. In order to demonstrate these principles, the invention is described herein by reference to specific preferred embodiments. The invention, however, is not limited to the forms illustrated and described. Furthermore, the invention is not limited to use in connection with any particular size or shape of water retention cell or arrangement of storm water collection and distribution system but may find utility in various other applications involving collection and subterranean storage of water.

For purposes of this disclosure the terms "cell," "pit," "envelope" and the like are used interchangeably to mean any subterranean void in which storm water may be collected. Likewise, "assembly" is used herein in its broadest sense to denote a collection of interconnected bodies which may be arranged to form a structural supporting core for a storm water retention cell.

Storm water management systems, regardless of the means for collection and ultimate disposition of the collected water, require facilities for temporary retention of large quantities of water. Open pits and the like which collect surface run-off, along with other disadvantages, generally occupy too much valuable surface area and thus are increasingly being replaced by underground retention cells.

Subterranean water retention cells may be either enclosed containers (in which water is collected and stored for later disposition) or porous structures which permit ingress and/or egress of water through porous walls, floors, roofs and the like. Regardless of the type of retention cell, the cell structure must be sufficiently sturdy to support the overburden under which the retention cell is buried. Where the cell volume is relatively large and the overburden (such as a large structure, roadway for heavy vehicles, etc.) is substantial, the water retention cell must be designed to support the anticipated load.

A typical enclosed water retention cell 10, as illustrated in FIG. 1, comprises a floor 11, a top 12 and side walls 13. In an enclosed cell such as illustrated in FIG. 1, an inlet 14 and an outlet 15 are generally provided. It will be appreciated, however, that the walls, floor and/or top may be waterproof or porous to permit entry or outlet seepage, as desired.

Since the cell 10 is to be located underground, the structure must be sufficiently sturdy to support the anticipated overburden 16. However, construction costs must be minimized without substantially decreasing the fluid volume of the cell 10.

Typically, the floor 11, top 12 and side walls 13 are formed of flexible material such as plastic or the like and form an envelope supported by an internal core structure 100 and the surrounding earth 101. The core structure 100, however, must be sufficiently sturdy to support the overburden; must be inexpensive and easy to assemble; must be resistant to decay and deterioration; and must not substantially reduce the fluid capacity of the cell 10.

Figure 2:
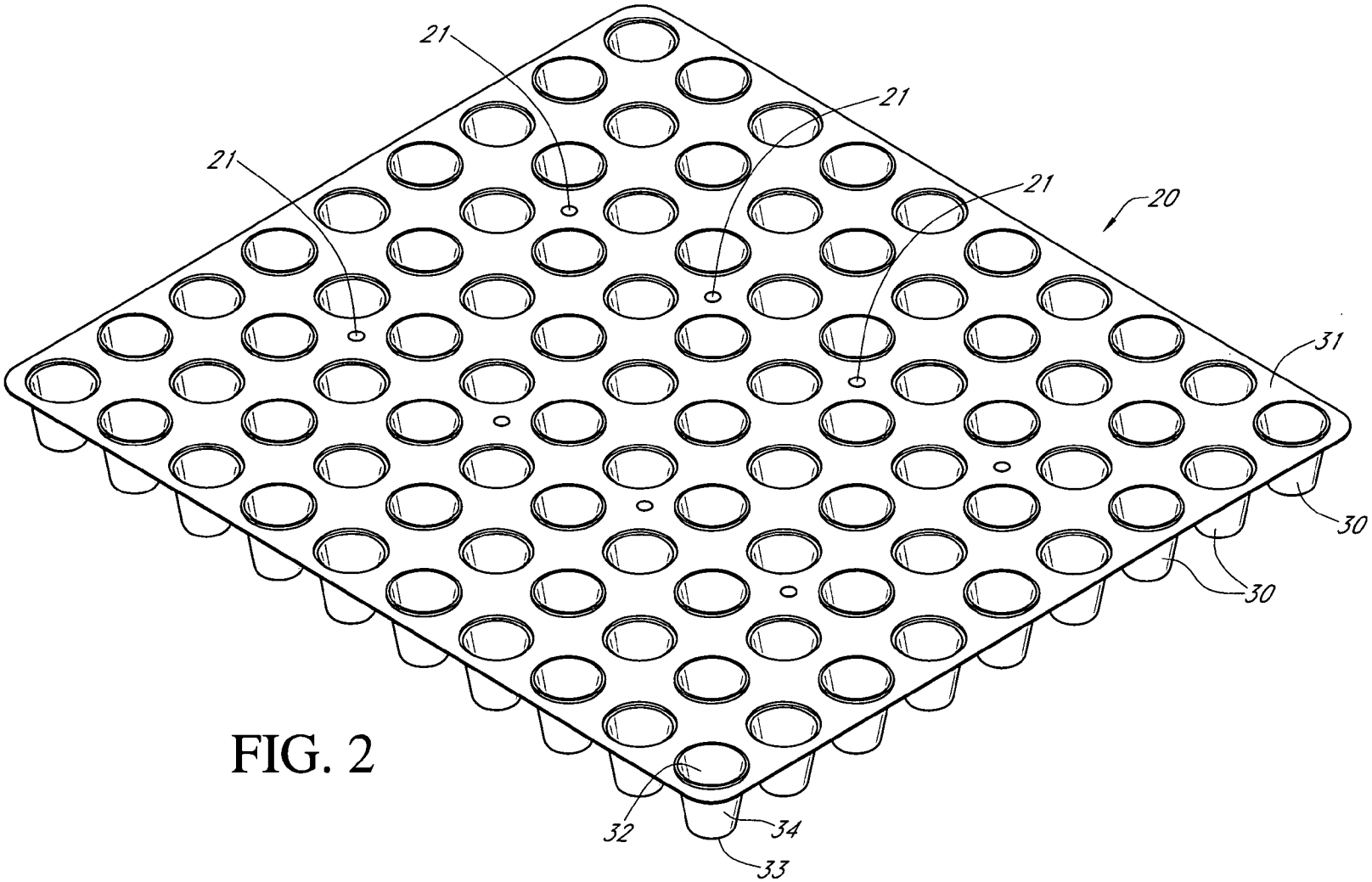
FIG. 2 is a top perspective view of an assembly of the invention containing an array of frustum-shaped conical bodies.
Figure 3:
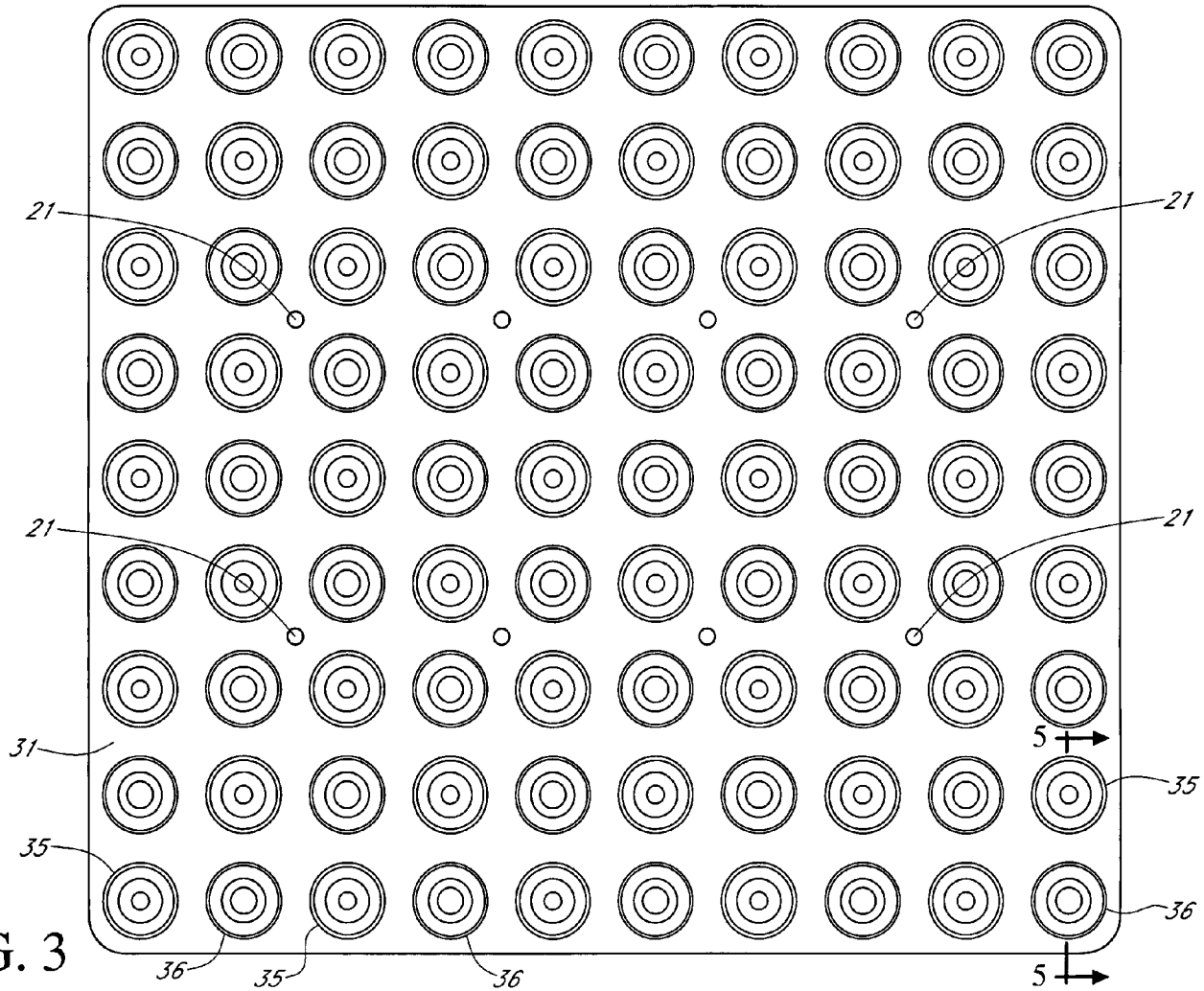
FIG. 3 is a top plan view of the assembly of FIG. 2.
Figure 4:
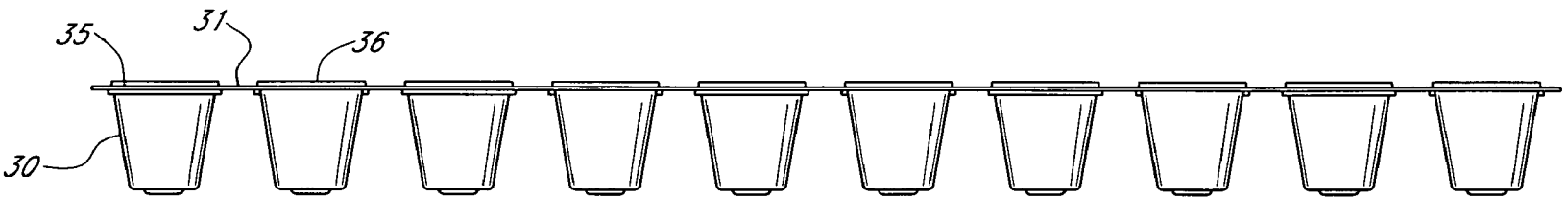
FIG. 4 is a side elevational view of the assembly of FIG. 2.
Figure 5:
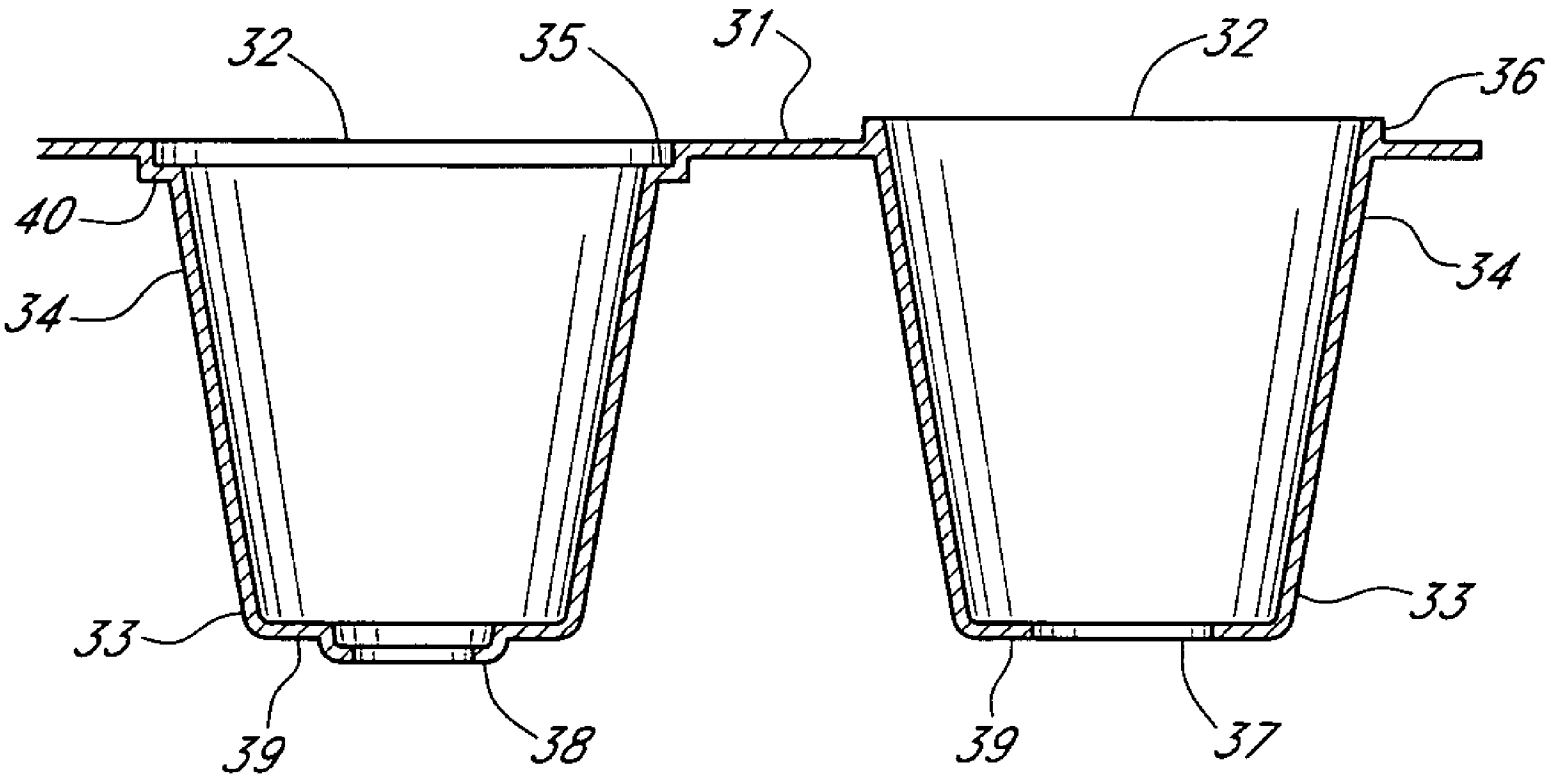
FIG. 5 is a sectional view of a portion of the assembly of FIG. 3 taken through line 5-5.
Figure 6:
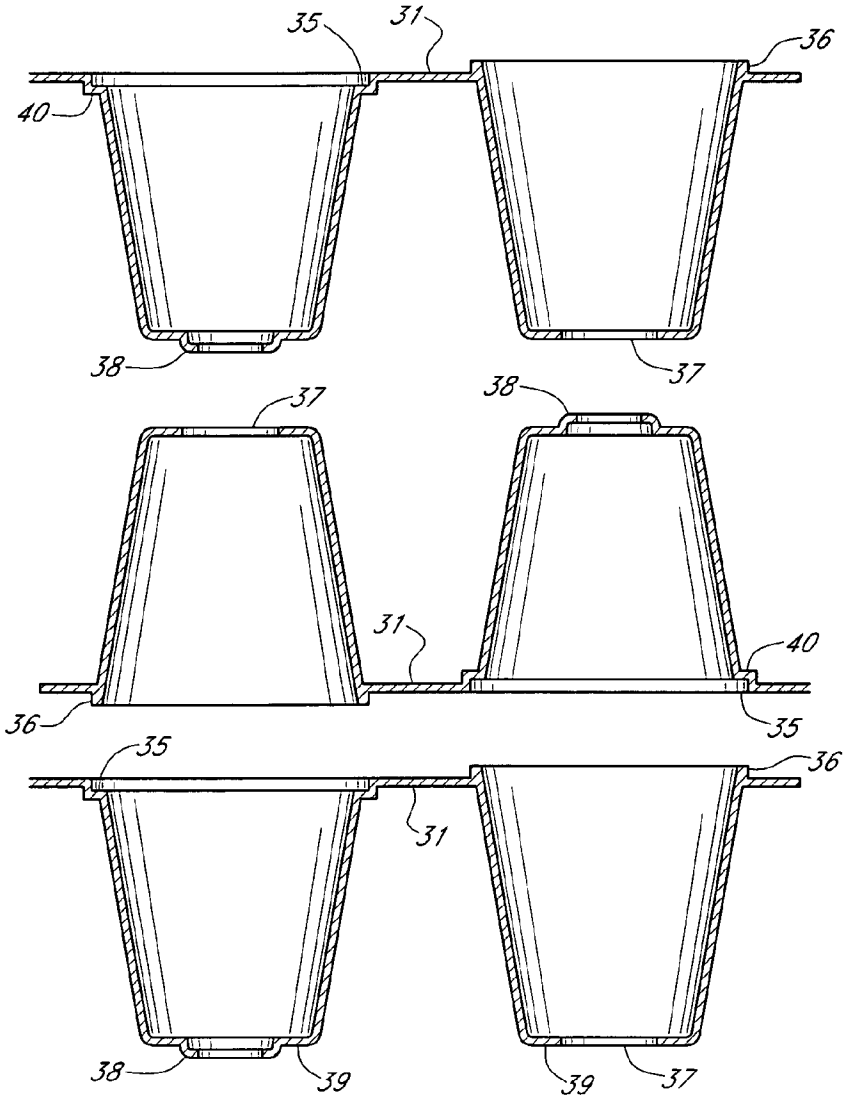
FIG. 6 is an exploded sectional view, partially broken away, illustrating the alternating inverted arrangement of assemblies of FIG. 2 to form a cell core matrix in accordance with the invention.

FIGS. 2-6 illustrate a preferred embodiment of a core assembly 20 of the invention which may be used to construct a core structure 100 having all the desired features and advantages. As illustrated in FIGS. 2-4 the assembly 20 comprises an array of hollow frustum-shaped bodies 30 supported on a support structure 31. Each frustum-shaped body 30 has a larger open end 32 and a smaller end 33 (see FIG. 5) and the bodies 30 are supported on support structure 31 with their larger ends 32 terminating in a first plane and their smaller ends 33 terminating in a second plane parallel with and spaced from the first plane. The ends 32, 33 are connected by sloping side walls 34 to define the frustum configuration. In the preferred embodiment, the frustum-shaped bodies are conical but may be of any other desired geometrical configuration such as hexagonal, octagonal or the like in cross-section.

In the embodiment illustrated, the support structure 31 is sheet or panel extending parallel with and connecting the larger ends 32. It will be realized, however, that support structure 31 may take various other forms and be disposed at other positions relative to the frustum-shaped bodies. The functions of support structure 31 are primarily to maintain the spacing between and arrangement of bodies 30 and to provide lateral stability of the core structure 100 as discussed hereafter.

To form a core structure 100 such as illustrated in FIG. 1, multiple assemblies 20 are positioned horizontally and stacked in alternately inverted layers so that the larger ends 32 in one layer mate with larger ends 32 in an adjacent layer and smaller ends 33 mate with smaller ends 33 in an adjacent layer. When arranged in this manner, the frustum-shaped bodies 30 form parallel hollow vertical columns supported horizontally by support structure 31 as illustrated in FIG. 1.

In the preferred embodiment illustrated, axial alignment of the bodies 30 forming each vertical column is assured by connector means which join the mating ends of each pair of frustum-shaped bodies. As more clearly illustrated in FIGS. 5 and 6 the connector means for interconnecting the mating larger ends 32 of two frustum-shaped bodies may be a recess or groove 35 in the open end of one of the mating bodies adapted to receive and mate with a lip or tongue 36 projecting from the open end of the other body 30. Similarly, the connector means for interconnecting the mating smaller ends 33 of two frustum-shaped bodies may be as simple as hole 37 in the smaller end 33 of one body 30 which receives a tongue or boss 38 projecting from the smaller end 33 of the other. In the embodiment illustrated, the smaller end of each frustum-shaped body 30 is partially enclosed by a horizontally extending floor 39. The mating surfaces of floor 39 provide structural support for the vertical forces exerted on the vertical columns. Similarly, the grooves 35 in the larger ends of the bodies 30 each provide a shoulder 40 for the same purpose.

It will be understood that other connector means may be employed to join the mating ends of the frustum-shaped bodies. For example, the grooves 35, tongues 36, holes 37, bosses 38 and/or floors 39 may be provided with ridges, clamps, hooks, holes, ratchets or the like which interconnect the bodies 30 to form rigid columns. If desired, the mating ends of the bodies 30 may be secured together with glue or the like.

The assembly 20 may be formed of any suitable material by any suitable means which provides the necessary structural strength and minimum solid volume. In the preferred embodiment, the assembly 20 is formed by continuous thermal forming or injection molding of plastic materials such as polyethylene, polypropylene, PVC, HIPS or the like. Depending on the materials used, the design configuration and the load-bearing capacity required, the material thickness of the components of the assembly should be as thin as possible to minimize solid volume and thus maximize fluid volume of a water retention cell utilizing a core structure 100 comprised of alternately inverted assemblies 20.

In the preferred embodiment, each assembly is formed in a 10×9 array of frustum-shaped bodies 30 arranged on 76.2 mm centers. Each body 30 is 60 mm deep. The diameter of the larger end is 51.8 mm and the diameter of the smaller end is 36 mm, resulting in a frustum-shaped body 30 in which the inclination of the side walls 34 is 10° from vertical. Since the side walls of the frustum-shaped body are inclined with respect vertical, the vertical load-bearing capacity of a column comprised of such bodies greatly exceeds the vertical load-bearing capacity of hollow cylindrical columns having the same wall thickness. Furthermore, the structural rigidity of a core structure formed of assemblies 20 is described herein far exceeds the structural rigidity of a core structure of equivalent solid volume formed of cylindrical tubes or the like.

In the embodiment illustrated in FIGS. 2-4, the larger open ends 32 of bodies 30 which contain grooves 35 are aligned in rows positioned between rows of the larger open ends 32 of bodies 30 having tongues 36 so that each row of open larger ends is presented in an alternating pattern of tongue/groove/tongue/groove. Likewise, the smaller ends are arranged in an alternating pattern of hole/boss/hole/boss. Accordingly, when one assembly 20 is inverted and positioned over another assembly 20, the groove 35 and tongue 36 of adjacent larger ends 32 will mate with each other and form the required interconnection. The adjacent smaller ends 33 will likewise mate to form the vertical columns as illustrated in FIG. 1.

It will be appreciated that a plurality of assemblies 20 of identical structure may be positioned onsite to form core matrix for a water retention cell 10 of any desired dimensions. Since the ends of the bodies 30 in each alternating inverted layer are adapted to be interconnected simply by proper relational placement, the entire core may be assembled without special tools or assembly techniques. When the core structure is assembled as illustrated in FIG. 1, the frustum-shaped bodies form vertical load-bearing columns which are horizontally stabilized by the horizontally-extending support structure 31. It will be appreciated, of course, that support structure 31 need not be continuous flat sheets but may contain holes 21 or the like to allow free circulation of water and to reduce the fluid volume occupied by the core matrix. Other configurations of horizontal support structure 31 may be employed as desired.

Where the core structure 100 is employed in a closed cell as illustrated in FIG. 1, a rigid porous mat 17 or the like may be positioned on the top layer of assemblies 20 (and/or the floor 11) to aid in equal distribution of weight and aid in free circulation of water into and out of the columns formed by the frustum-shaped bodies 30.

It will be further appreciated that the alternately inverted frustum-shaped bodies of the invention need not be provided in assemblies 20 of limited size. The product may be formed in large sheets or in continuous lengths which are rolled for trans-shipment and cut to desired length onsite. However, with the frustum-shaped bodies 30 formed in assemblies 20 and interconnected by support structure 31 attached at the larger ends 32 thereof, the assemblies 20 may be arranged in nested stacks for shipment and storage.

It will be apparent from the foregoing that the principles of the invention may be used to form core structural assemblies for a wide variety of water retention cells. The shape and size of the assembly, as well as the materials of construction and arrangement of components, may be varied as desired to accommodate a wide variety of applications.

It is to be understood that even though numerous characteristics and advantages of the invention have been set forth in the foregoing description together with details of the structure and function of the invention, this disclosure is to be considered illustrative only. Various changes and modifications may be made in detail, especially in matters of shape, size, arrangement and combination of parts, without departing from the spirit and scope of the invention as defined by the appended claims.

What is claimed:

1. An assembly comprising:

(a) a plurality of hollow frustum-shaped bodies, each such body having a larger open end and a smaller end connected by side walls, supported in an arrangement with the larger ends terminating in a first plane and the smaller ends terminating in a second plane spaced from and parallel with said first plane;

(b) connector means formed on at least some of said larger ends adapted to mate with connector means on the larger ends of such frustum-shaped bodies in a substantially similar assembly inverted and positioned with the larger ends of its frustum-shaped bodies in a plane parallel with and adjacent said first plane; and (c) connector means formed on at least some of said smaller ends adapted to mate with connector means on the smaller ends of such frustum-shaped bodies in a substantially similar assembly inverted and positioned with the smaller ends of its frustum-shaped bodies in a plane parallel with and adjacent said second plane.

2. An assembly as defined in claim 1 wherein said frustum-shaped bodies are aligned in parallel rows.

3. An assembly as defined in claim 1 wherein said frustum-shaped bodies are supported in said arrangement by horizontally-extending support structure.

4. An assembly as defined in claim 3 wherein said horizontally-extending support structure comprises a sheet extending parallel with and connecting said larger open ends.

5. An assembly as defined in claim 4 wherein said sheet defines holes therein to permit circulation of water therethrough.

6. Core structure for water retention cells comprising a plurality of vertically extending columns interconnected with horizontally-extending support structure wherein said columns comprise a plurality of hollow frustum-shaped bodies arranged end-to-end, each frustum shaped body having a larger open end and a smaller end joined by an inclined side wall, arranged with the smaller ends of vertically adjacent frustum-shaped bodies positioned adjacent each other and the larger open ends of vertically adjacent frustum-shaped bodies positioned adjacent each other.

7. Core structure as defined in claim 6 wherein said horizontally extending support structure comprises a panel supporting the larger open ends of a plurality of frustum-shaped bodies in a horizontal plane.

8. Core structure for water retention cells comprising a plurality of vertically extending columns interconnected with horizontally-extending support structure wherein said columns comprise a plurality of hollow frustum-shaped bodies arranged end-to-end, each frustum shaped body having a larger open end and a smaller end joined by an inclined side wall, arranged with the smaller ends of vertically adjacent frustum-shaped bodies positioned adjacent each other and the larger open ends of vertically adjacent frustum-shaped bodies positioned adjacent each other, wherein the smaller ends of said frustum-shaped bodies define connector means for securing the adjacent smaller ends of two of said frustum-shaped bodies together.

9. Core structure for water retention cells comprising a plurality of vertically extending columns interconnected with horizontally-extending support structure wherein said columns comprise a plurality of hollow frustum-shaped bodies arranged end-to-end, each frustum shaped body having a larger open end and a smaller end joined by an inclined side wall, arranged with the smaller ends of vertically adjacent frustum-shaped bodies positioned adjacent each other and the larger open ends of vertically adjacent frustum-shaped bodies positioned adjacent each other, wherein the larger ends of said frustum-shaped bodies define connector means for securing the adjacent larger ends of two of said frustum-shaped bodies together.

10. Core structure for water retention cells comprising a plurality of vertically extending columns interconnected with horizontally-extending support structure wherein said columns comprise a plurality of hollow frustum-shaped bodies arranged end-to-end, each frustum shaped body having a larger open end and a smaller end joined by an inclined side wall, arranged with the smaller ends of vertically adjacent frustum-shaped bodies positioned adjacent and joined end-to-end with each other and the larger open ends of vertically adjacent frustum-shaped bodies positioned adjacent each other.

11. Core structure as defined in claim 10 wherein said horizontally extending support structure comprises a panel supporting the larger open ends of a plurality of frustum-shaped bodies in a horizontal plane.

12. Core structure as defined in claim 10 wherein the smaller ends of said frustum-shaped bodies define connector means for securing the adjacent smaller ends of two of said frustum-shaped bodies together.

13. Core structure as defined in claim 10 wherein the larger ends of said frustum-shaped bodies define connector means for securing the adjacent larger ends of two of said frustum-shaped bodies together.

* * * * *